US006112364A

United States Patent [19]

Myers

[11] Patent Number: 6,112,364

[45] Date of Patent: Sep. 5, 2000

[54] GOLF CLUB CLEANING TOOL

[76] Inventor: Joseph P. Myers, 3078 Tilton St., Philadelphia, Pa. 19134

[21] Appl. No.: 09/421,340

[22] Filed: Oct. 19, 1999

[51] Int. Cl.[7] ..... A47L 25/00

[52] U.S. Cl. ..... 15/236.08; 15/105; 15/111

[58] Field of Search ..... 15/105, 111, 236.01, 15/236.05, 236.06, 236.08, 142, 402; 473/131, 282, 407, 408; 119/611, 613, 625; 172/378; 56/400.01, 400.17

[56] References Cited

U.S. PATENT DOCUMENTS

| | | | |
|---|---|---|---|
| 339,137 | 4/1886 | Brookbank | 15/142 |
| 410,774 | 9/1889 | Shrock | 172/378 |
| 423,640 | 3/1890 | Stiles | 15/142 |
| 1,262,482 | 4/1918 | Hales | 172/378 |
| 1,425,923 | 8/1922 | Weyhrauch | 15/142 |
| 1,621,276 | 3/1927 | Richardson | 56/400.17 |
| 1,693,492 | 11/1928 | Ostberg | 56/400.17 |
| 1,696,678 | 12/1928 | Henning | 172/378 |
| 2,529,012 | 11/1950 | Gleekman | 15/236.08 |
| 2,564,721 | 8/1951 | Raya | 15/236.05 |
| 3,170,182 | 2/1965 | Burian | 15/142 |
| 3,530,524 | 9/1970 | Clemans | 15/236.08 |
| 3,763,515 | 10/1973 | Voss | 15/236.08 |
| 3,994,040 | 11/1976 | DiStefano | 15/236.08 |
| 4,483,133 | 11/1984 | Pasley | 172/378 |
| 4,908,899 | 3/1990 | Killen . | |
| 5,007,129 | 4/1991 | Hainey . | |
| 5,121,519 | 6/1992 | Haugom . | |
| 5,226,647 | 7/1993 | Notarmuzi | 15/236.08 |
| 5,269,513 | 12/1993 | Gervais . | |
| 5,555,589 | 9/1996 | Moultrie . | |
| 5,733,208 | 3/1998 | Fazekas | 473/408 |

FOREIGN PATENT DOCUMENTS

| | | | |
|---|---|---|---|
| 2415425 | 9/1979 | France | 15/236.08 |
| 416133 | 7/1985 | Germany | 15/236.08 |

*Primary Examiner*—Randall E. Chin
*Attorney, Agent, or Firm*—Henderson & Sturm LLP

[57] ABSTRACT

A cleaning tool (10) for cleaning the grooves (102) on the face (101) of a golf club head (100); wherein the tool (10) includes a tool body member (20) having an inboard end (21) and an outboard end (22); wherein, the outboard end (22) of the tool body member (20) is provided with a plurality of elongated flexible metal tine members (30) having downwardly angled fingers (31) and pointed teeth (32) that are disposed generally perpendicular to the longitudinal axis of the tool body member (20) wherein each tooth (32) is dimensioned to be received in one of the grooves (102) on the face (101) of the club head (100).

3 Claims, 1 Drawing Sheet

GOLF CLUB CLEANING TOOL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of golf club cleaning devices in general and in particular to a golf club cleaning tool having a rake shaped cleaning implement.

2. Description of the Related Art

As can be seen by reference to the following U.S. Pat. Nos. 4,908,899; 5,007,129; 5,121,519; 5,269,513; and 5,555,589 the prior art is replete with myriad and diverse tools designed to clean the grooves on the faces of golf clubs.

While all of the aforementioned prior art constructions are more than adequate for the basic purpose for which they have been specifically designed, they are uniformly deficient with respect to their failure to provide a simple, efficient and practical golf club cleaning tool that is provided with a plurality of flexible cleaning tines which can simultaneously clean a plurality of grooves in the face of a golf club in a non-marring manner.

As every golfer is aware, the grooves that are employed on the face of a golf club are designed to impart spinning motion to the golf ball; and, it is imperative that those grooves be cleaned on a regular basis, ideally after each use of a particular club to obtain the optimum performance from each club.

As a consequence of the foregoing situation, there has existed a need for a new and improved golf club cleaning tool that employs a plurality of flexible tines wherein each tine ends in a sharpened tooth that will remove accumulated debris from the grooves in the club face; and, the provision of such a construction is the stated objective of the present invention.

BRIEF SUMMARY OF THE INVENTION

Briefly stated, the golf club cleaning tool that forms the basis of the present invention involves a tool body unit, a primary tool head unit and an auxiliary accessory unit.

As will be explained in greater detail further on in the specification, the tool body unit includes a generally tapered handle member; wherein the narrow end of the handle member is provided with the auxiliary accessory unit and the wide end of the handle member is provided with the primary tool head unit.

The primary tool head unit comprises a plurality of flexible tine members having inboard ends which are fixedly secured to the broad end of the tool handle member; wherein the outboard end of each tine member is provided with a downwardly angled finger portion which terminates in a sharpened tooth element.

In addition the auxiliary accessory unit comprises a selected one from a variety of accessory members which include a divot tool, a spring-loaded chip, a key chain, a spike wrench and a steel brush, anyone of which can be employed in combination with the tool body unit and the primary tool head unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
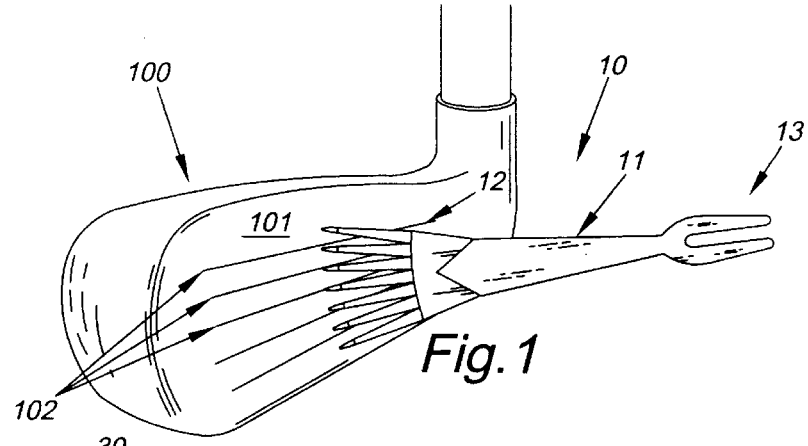
FIG. 1 is a perspective view of the cleaning tool engaged with the grooved face of a golf club.

As can be seen by reference to the drawings, and in particulary to FIG. 1, the golf club cleaning tool that forms the basis of the present invention is designated generally by reference number (10). The cleaning tool (10) comprises in general a tool body unit (11), a primary tool head unit (12) and an auxiliary accessory unit (13). These units will now be described in seriation fashion.

Figure 2:
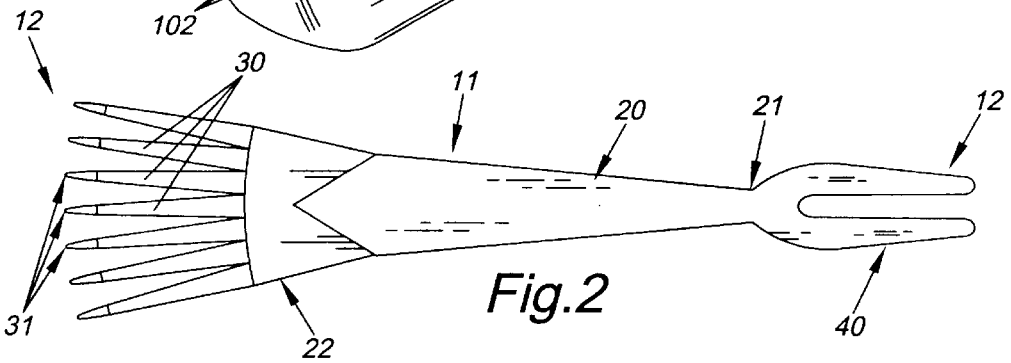
FIG. 2 is a top plan view of the golf club cleaning tool.
Figure 3:
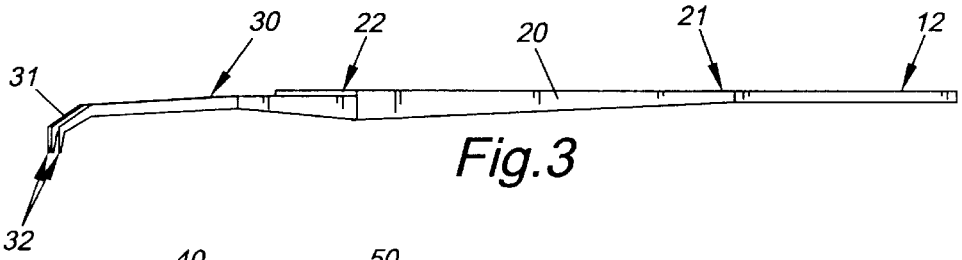
FIG. 3 is a side elevation view of the golf club cleaning tool.
Figures 4, 5, 6, 7, 8:
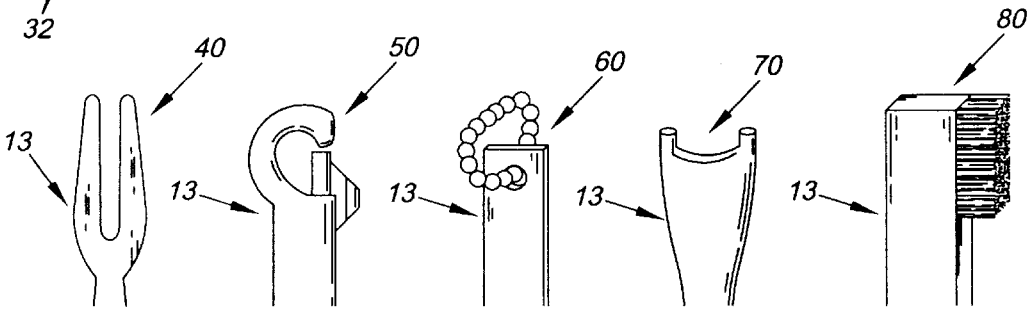
FIGS. 4–8 show the various embodiments of the auxiliary accessory unit that may be employed in combination with the golf club cleaning tool

As can best be seen by reference to FIGS. 2 and 3, the tool body unit (11) comprises a generally elongated tapered tool body member (20) having a narrow inboard end (21) associated with the auxiliary accessory unit (13) and a broad outboard end (22) associated with the primary tool head unit (12).

Still referring to FIGS. 2 and 3, it can be seen that the primary tool head unit (12) comprises a plurality of elongated flexible metal tine members (30) which project outwardly from the broad end (22) of the tool body member (20) in a quasi-rack fashion wherein the outboard of each tine members (30) has a downwardly angled finger element (31) which terminates in a sharpened tooth (32) which is disposed generally perpendicular to the longitudinal axis of the tool body member (20).

In addition, as depicted in FIG. 1, the sharpened teeth (32) of the tine members (30) arc dimensioned to fit within the grooves (102) on the face (101) of a golf club head (100) to pick and/or scrape out any accumulated debris that are deposited in the grooves (102) after the golfer swings the golf club in the normal fashion.

It should also be appreciated at this juncture that the flexible nature of the elongated tine members (30) allows the teeth (32) to move independently of one another such that the raking motion of the cleaning tool (10) across the face (101) of the club head (100) will not be interrupted when one tooth (32) encounters a groove (102) having an embedded obstruction.

As a consequence of the foregoing situation, the tooth (32) that encounters the immoveable obstruction will be deflected over the obstruction and then reseat itself within the obstructed groove to clean the remainder of that groove while the remaining teeth will be maintained in constant control with the interior surface of the grooves.

In the embodiment illustrated in FIGS. 1–3, it can be seen that the auxiliary accessory unit (13) comprises a divot repair tool (40) which is provided on the inboard end of the tool body member (20). However, as was mentioned earlier on in the specification and illustrated in FIGS. 4–8, the auxiliary accessory unit (13) can be selected from among the following: a divot repair tool (40); a spring loaded clip (50); a key chain arrangement (60); a spike wrench (70); and a wire brush (80) wherein any one of the foregoing would be suitable for use in combination withe the tool body unit (11) and the primary tool head unit (12).

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having hereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A cleaning tool for cleaning the grooves on the face of a golf club wherein the cleaning tool comprises:

a tool body unit including an elongated tool body member having an inboard end and an outboard end; and a primary tool head unit disposed on the outboard end of the tool body member and including a plurality of elongated flexible metal tines having inboard ends fixedly secured to the tool body member and having outboard ends provided with teeth that are dimensioned to be received in the grooves on the face of a golf club wherein said teeth are disposed generally perpendicular to the longitudinal axis of the tool body member and wherein a portion of the outboard ends of the tine members are provided with downwardly angled finger elements which are disposed intermediate the teeth and the inboard ends of the tine members, further comprising an auxiliary accessory unit provided on the inboard end of the tool body member, the auxiliary accessory unit being a divot repair tool.

2. The cleaning tool as in claim 1; wherein the tool body member has a tapered configuration.

3. The cleaning tool as in claim 2; wherein the inboard end of the tool body member is relatively narrow and the outboard end of the tool body member is relatively broad.

* * * * *